United States Patent [19]

Kim

[11] Patent Number: 4,729,460

[45] Date of Patent: Mar. 8, 1988

[54] COVER FOR A CARRYING CASE

[75] Inventor: Hyun S. Kim, New Castle, Pa.

[73] Assignee: Airway Industries, Inc., Ellwood City, Pa.

[21] Appl. No.: 11,339

[22] Filed: Feb. 5, 1987

[51] Int. Cl.[4] ..... A45C 13/00; A45C 3/00

[52] U.S. Cl. ..... 190/109; 190/111; 190/124; 190/126

[58] Field of Search ..... 190/109, 111, 124–127, 190/113; 150/112, 117

[56] References Cited

U.S. PATENT DOCUMENTS

| | | | |
|---|---|---|---|
| 1,907,676 | 5/1933 | Roth | 150/1.6 |
| 2,316,328 | 4/1943 | Guenther et al. | 150/1.6 |
| 2,562,499 | 7/1951 | Lifton | 190/113 X |
| 2,609,897 | 9/1952 | Meyer | 190/111 |
| 2,695,085 | 11/1954 | Ritter, Jr. | 190/43 |
| 3,126,076 | 3/1964 | Koffler | 190/43 |
| 3,447,649 | 6/1969 | Kish, Jr. | 190/113 X |
| 4,287,971 | 9/1981 | Doulet | 150/117 X |
| 4,307,765 | 12/1981 | Davis | 150/1.6 |
| 4,350,546 | 9/1982 | Davis | 156/93 |
| 4,561,525 | 12/1985 | Shidner | 190/106 |

FOREIGN PATENT DOCUMENTS

| | | | |
|---|---|---|---|
| 534936 | 2/1955 | Belgium | 190/124 |
| 355488 | 8/1931 | United Kingdom | 190/111 |

*Primary Examiner*—William Price

*Attorney, Agent, or Firm*—Walter J. Blenko, Jr.; Suzanne Kikel

[57] ABSTRACT

A front cover with a pocket for a carrying case comprising a backing sheet with an array of panel sections and a pocket overlapping the edges of the panels and the exposed area of the backing sheet such that the pocket is a single thickness of skin material. Gussets are made along the longitudinal sides of the pocket so that it extends outwardly on the front cover. Securement of the pocket and panel sections onto the backing sheet is done by sewing and including the panels and pocket into the welt around the outer peripheral edge of the front cover.

9 Claims, 6 Drawing Figures

COVER FOR A CARRYING CASE

This invention relates to a front cover for a carrying case, such as a luggage case, and has particular relation to a cover comprising a lining or backing sheet having an array of panels and a novel pocket construction overlying the exposed area of the backing sheet near the edges of the panels.

A front cover for a carrying case such as a luggage case, brief case, tote bag, school bag, etc. commonly contains an outer wall comprised of a single sheet of material onto which a pocket may be attached. Such a pocket is for carrying small, light-weight personal items and is customarily located on and attached by stitching to the outer wall of the carrying case. Some pocket constructions may be referred to as a "patch" pocket whereby the pocket is sewn directly onto the outer wall of the case. Such "patch" pockets are shown for example in U.S. Pat. Nos. 1,907,676; 2,696,085; 3,126,076; and 4,561,525. The pockets in these patents may be expandable by providing excess material as by pleating shown for example in the aforementioned U.S. Pat. No. 1,907,676, or as by gusseting between the outer wall of the pocket and the outer wall of the carrying case, shown for example in the aforementioned U.S. Pat. Nos. 2,695,085 and 3,126,076 (FIG. 2). Alternately, the pocket may be in an expanded form prior to its securement to the outer wall of the front cover as shown for example in the aforementioned U.S. Pat. No. 4,561,525.

One main drawback to the covers of the cases of the sort mentioned above is the added cost and weight involved in that the pocket is commonly made from the same material as the outer wall and covers an area of the outer wall which commonly is made of an expensive piece of relatively heavy, durable material.

Other drawbacks in the carrying cases of the sort mentioned above is in the pocket construction having a limited carrying capacity and a limited ease of accessibility. These pocket constructions are complicated requiring several pieces of material to be cut and sewn together for the expansion feature. As mentioned above, the outer wall of the case is the inner wall for the pocket. The material for the outer wall of the case is commonly of a rough texture, such as leather, which may prove difficult to clean in that dirt and grime eventually become embedded in the pores of the material.

I provide a front cover for a carrying case including a pocket which is of a simple, inexpensive, and yet light-weight construction.

I further provide a front cover for a carrying case in which the pocket dominates the area thereon such that only bordering material panels are necessary to cover the remaining area of a backing sheet constituting the front cover.

I further provide an expandable pocket construction with an increased carrying capacity, an increased ease in accessibility, and an enhanced appearance in its attachment to the front cover.

More specifically, I provide a front cover for a carrying case comprising a lining or backing sheet, an array of panels arranged on the backing sheet, and a pocket construction extending over the backing sheet between the edges of the panels whereby the backing sheet becomes the inner wall for the pocket. This backing sheet, preferably, has smooth surfaces and is of a flexible, yet durable piece of material. The array of panels may be one or several pieces of material positioned around the pocket and attached by binding strip to the backing sheet. Welting is attached around the periphery of this front cover to finish the cover. Preferably, the material for the pocket and for the array of panels is the same, and in conjunction with the binding strip acts to enhance the appearance of the carrying case.

And, I still further provide a novel pocket construction comprising two tenuous, yet sturdy pieces of fabric material, preferably connected together by slide fastener means, and dart means on each of the four corners of the pocket such that the pocket extends outwardly a distance to accommodate the bulk of its contents, and lies in a substantially flat condition when the pocket carries less bulky contents or is empty.

Broadly, I provide a luggage case with an outer wall comprising a thickness of lining material, a thickness of trim material overlying only a part of the lining material, pocket material overlying at least that portion of the lining material which is not covered by the trim material, said lining material being substantially coextensive with said pocket material, and securing means holding together along a line the lining material, the trim material, and the pocket material.

The above-described and other details of the present invention will become apparent in the description of a preferred embodiment hereinafter fully set forth when read in connection with the accompanying drawings herein.

Referring to the FIGS. 1–6, there is shown a luggage case 10, which is of a light-weight construction comprising a main body portion 12 and a hinged front cover 14.

Figure 1:
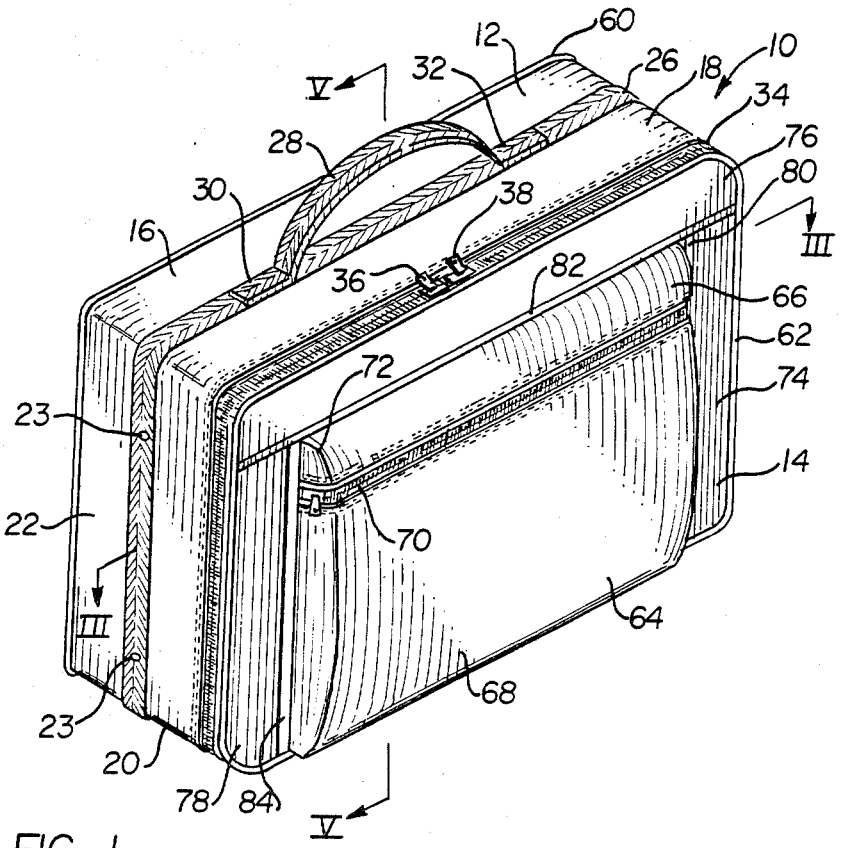
FIG. 1 is a perspective view of an embodiment of the present invention showing a luggage case in a closed positioning.
Figure 2:
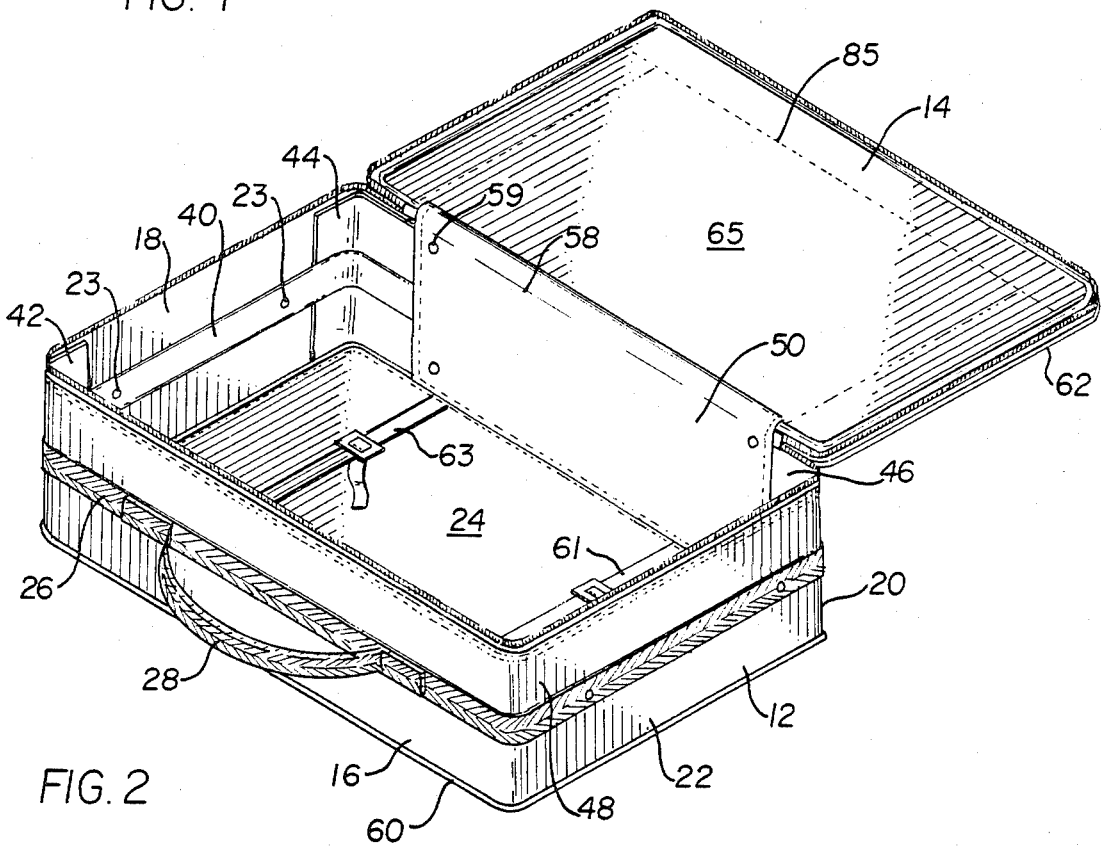
FIG. 2 is a perspective view of the luggage case of FIG. 1 with its front cover raised away from its body portion to expose the interior.

As particularly shown in FIGS. 1 and 2, the main body portion 12 consists of walls 16, 18, 20, and 22, and side 24 (FIG. 2). Walls 16, 18, 20, and 22 are of a sturdy flexible material and are part of a supporting frame for luggage case 10. In referring particularly to FIG. 1, a binding strip 26 encircles walls 16–22, and is symmetrically positioned and attached by suitable means as by a plurality of rivets 23 along the outside of walls 16, 18, 20, and 22 of the main frame of main body portion 12. A handle assembly 28 is affixed by suitable means as by rivets (not shown) to the top wall 16 of body portion 12 along binding strip 26.

The rivets for handle assembly 28 extend down through anchoring tabs 30, 32 located on the opposed ends of handle assembly 28 into binding strip 26. Handle assembly 28 may be similar to that disclosed in the Applicant's pending application bearing U.S. Ser. No. 868,099 filed on May 29, 1986.

Still referring to FIG. 1, a slide fastener 34 with tabs 36 and 38 is provided for opening and closing the luggage case 10. Sliding of tabs 36, 38 in an opposite direction relative to each other accomplishes the opening or closing of the body portion 12 from front cover 14.

FIGS. 2, 3, 5, and 6 particularly show the inside of luggage case 10. A reinforcing strip element 40 extends around the periphery on the inside of body portion 12 adjacent to walls 16, 18, 20 and 22, and the outer binding strip 26 so that rivets 23 for binding strip 26 and the rivets for handle assembly 28 extend down through reinforcing strip element 40. Strip element 40 is approximately the same width as strip binding 26; is of a rigid light-weight material, such as stainless steel or aluminum, and supports walls 16–22 thereby acting as a framework for luggage case 10. Even though not shown, material such as plastic or vinyl is wrapped around reinforcing strip 40 to give it a similar appearance as the interior of body portion 12.

Further rigidity is given to walls 16, 18, 20, 22 of luggage case 10 by L-shaped brace members indicated at 42, 44, 46, and 48 and located at the corners of body portion 12 (FIG. 2). These brace members 42–48 extend the width of walls 16–22, are located beneath and retained by strip element 40, and are of a rigid, durable material, such as plastic. As previously mentioned, rivets 23 hold binding strip 26 to walls 16–22 and strip element 40.

Figure 4:
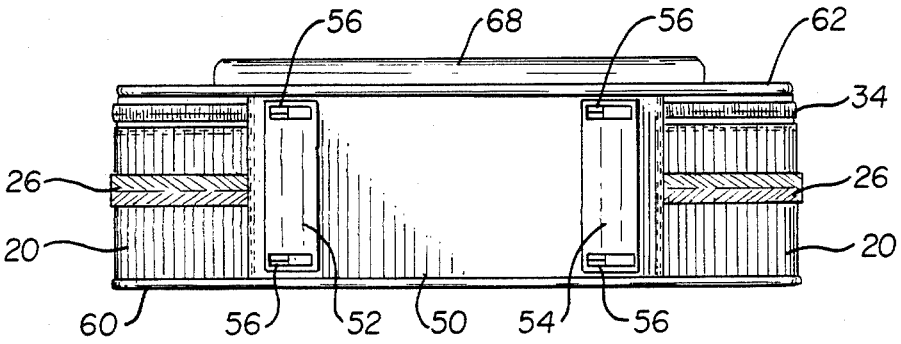
FIG. 4 is a bottom elevational view of the luggage case in FIG. 1.
Figure 5:
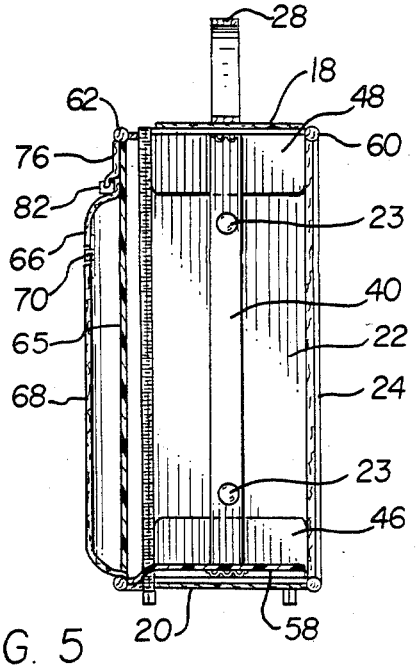
FIG. 5 is a sectional view taken along lines 5—5 in FIG. 1.

As particularly shown in FIGS. 2 and 4, strip element 40, the material comprising wa11s 16–22, and binding strip 26 all extend down to and along the bottom wall 20 a distance where they are fastened through suitable means to rigid base member 50. Base member 50 provides a support for plates 52 and 54, through which in a conventional manner, casters 56 are attached.

Base member 50 has affixed to it a suitably reinforced hinge member 58 made of cloth, fiber, plastic or vinyl material and connecting cover 14 to body portion 12 (FIG. 2). This securement of hinge member 58 to base member 50 is done by fastening with rivets 59 one end of hinge member 58 to the interior of body portion 12 along bottom wall 20. Hinge member 58 is secured to the interior of cover 14 through means which wil be discussed hereinafter.

Side 24 of luggage case 10 consists of a one piece, single layer of material stretched to extend the height and length of luggage case 10, and affixed to the material of walls 16–22 by welt 60 through a welting process, which is a process well known in the luggage industry, involving a folding and stitching of the several materials which are to be connected together. Garment holding belts 61, 63 extend across side 24 from the bottom wall 20 to top wall 16 and are included in welt 60 for their securement (FIG. 2).

Until now body portion 12, which is of a well-known construction in the luggage industry, has been exp1ained. The essence of the invention which involves front cover 14 will now be explained with particular reference to FIGS. 2, 3, 5 and 6. Front cover 14 comprises a backing sheet 65 which is a one piece, single layer of flexible yet durable material, such as cloth, fiber, plastic or vinyl, more about which is discussed hereinafter. Cover 14 is finished along its peripheral edges by welt 62 which secures a portion of slide fastener 34 to cover 14. Cover 14 is connected to body portion 12 by hinge base member 58, which member 58 is secured by stitching included into we1t 62 along the bottom wall 20 of luggage case 10 (FIG. 2).

A pocket 64 is attached to a piece of a lining material or backing sheet 65. Pocket 64 is comprised of upper piece 66 and lower piece 68, which are of a flexible, yet sturdy material such as cloth, fiber, plastic or vinyl. Upper piece 66 and lower piece 64 are connected together along their cooperative edges by slide fastener 70 which is secured by stitching best shown in FIGS. 1 and 6. Depth is given to pocket 64 (FIGS. 1, 5, and 6), by making gussets along both longitudinal sides of pocket 64 by a tapered tuck or dart made by stitching in each of the four corners of pocket 64. Each dart 72 is approximately one inch long with the taper extending inwardly from the outer corner edges of pocket 64, and are made prior to attaching pocket 64 to backing sheet 65 of front cover 14.

Pocket 64 is attached to backing sheet 65 through the use of an array of panel sections 74, 76, and 78 and binding strips 80, 82, 84 (FIGS. 1, 3 and 6) which sections 74, 76, and 78 are of a thickness of trim material overlying a part of lining 65 not covered by pocket 64. These panel sections 74–78 are pieces of skin material cut from a bolt of material, preferably the same bolt of material as pocket 64, walls 16–22, and side 24 of body portion 12. Panel sections 74–78 may be several distinct pieces or one piece cut out to accommodate pocket 64 along its three borders (FIG. 1). These sections 74–78 are of a material different from lining material or backing sheet 65 which preferably is less expensive and extends between and under top sections 76 and side sections 74 and 78 to give substantially a two-layer effect with lining material backing sheet 65 of cover 14 in those areas where backing sheet 65 is located beneath panels 74–78, and part of a three layer effect near the vicinity of the pocket edges.

Figure 3:
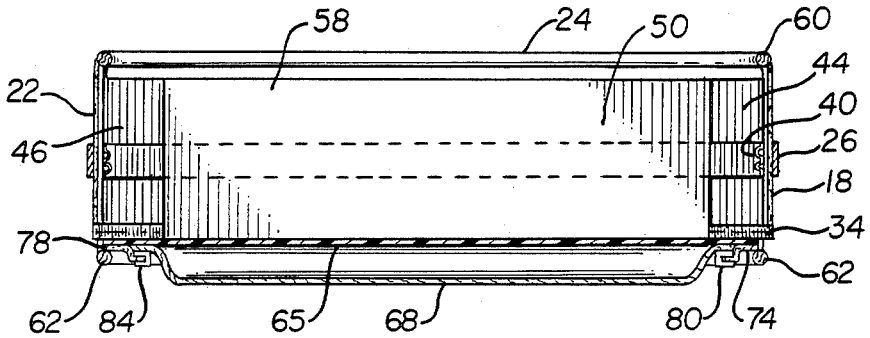
FIG. 3 is a sectional view taken along lines 3—3 in FIG. 1.
Figure 6:
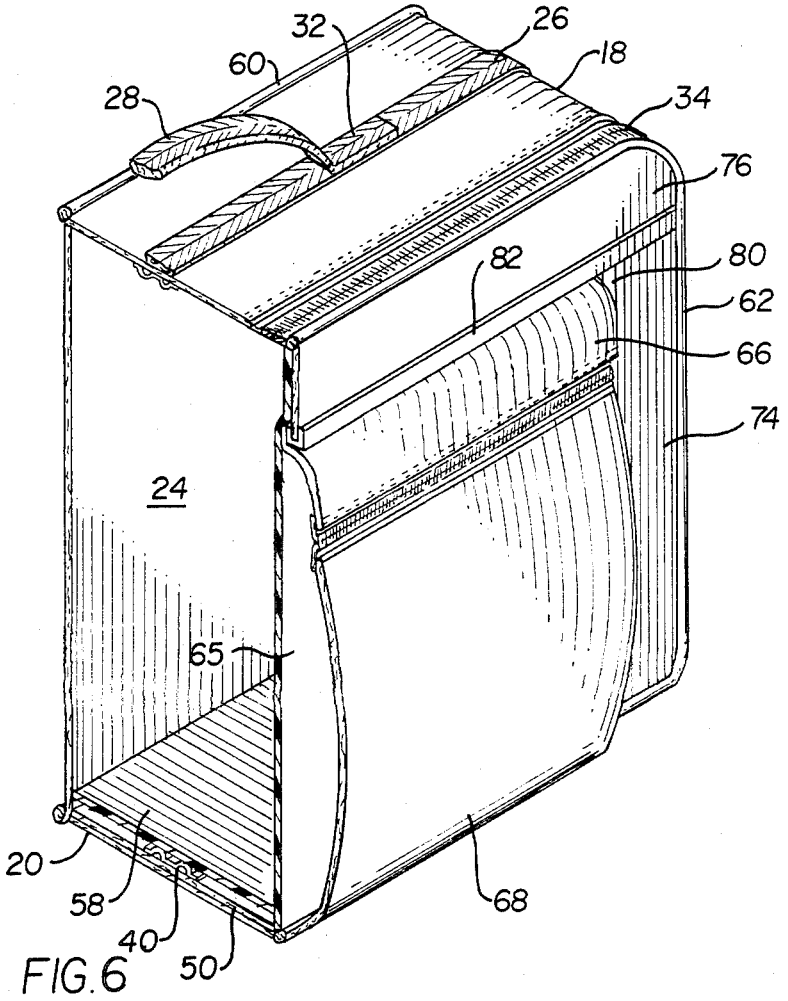
FIG. 6 is an enlarged sectional view taken down through the luggage case in a direction opposite to that of FIG. 5, and illustrating the pocket on the front cover of the luggage case in FIG. 1.

As shown in FIG. 6, binding strip 82 is folded around the edge of section 76, and as shown in FIG. 3, binding strips 80, 84 are also folded around the edge of their respective sections 74, 78. Securing of pocket 64 involves placement of panel sections 74, 78 and their respective attached binding strips 80, 84 along the longitudinal sides of pocket 64, with two corresponding outer edges of pocket 64 positioned beneath binding strips 80, 84 (FIGS. 1 and 6). Top panel section 76 and its strip 82 is placed over the upper edge of pocket 64 overlapping both sections 74, 78 to give a finished look thereto.

The bottom of pocket 64 is sewn into welt 62 of front cover 14, after the remaining three sides of pocket 64 adjacent panel sections 74, 76, 78 is affixed to backing sheet 65 of cover 14 by suitable means, preferably by stitching. Such stitching is done along binding strips 80, 82, 84 as is indicated at 85 in FIG. 2 on the interior of backing sheet 65 of cover 14. Backing sheet 65 becomes an innerwall for the main compartment of luggage case 10 and the inner wall for pocket 64. Securement of the peripheral edges of sections 74, 76, 78 and their binding strips 80, 82, 84 onto backing sheet 65 is done by including these edges into welt 62 around front cover 14.

As mentioned previously, the material for backing sheet 65 is lighter in weight than panel sections 74, 76, 78 and pocket 64 yet thick and durable enough to act as a backing for panels 74–78 and pocket 64.

With the front cover 14 of the invention, pocket 64 appears to be a patch pocket similar to that known in the art, which patch pocket can be defined as a piece of skin material with skin material inside. Such is not the case with the invention in that instead of the double thickness of skin material, there is a single layer of skin material and a backing sheet 65. The skin material for walls 16–22, side 24, sections 74–78 and upper piece 66 and lower piece 68 of pocket 64 will be relatively thicker than the material for backing sheet 65. Preferably backing sheet 65 will have a substantially smoother surface while the skin material for the luggage case 10 preferably will be a laminated textured material with smooth inner surfaces for the interior of the case 10 and pocket 64. The textured skin material enhances the appearance of luggage case 10 while at the same time provides a smooth surface finish for the inside of case 10 and pocket 64.

It is to be noted that the degree of rigidity or stiffness of the material of pocket 64 determines to what extent pocket 64 retains its outward positioning as shown in FIGS. 1, 3, 5 and 6, i.e., if the material is tenuous, then pocket 64 will have the tendency to collapse in on itself if it is substantially empty. Conversely, if pocket 64 is substantially full, then it will expand to some degree to accommodate the bulk of its contents.

Even though the front cover 14 of the invention has been described with reference to a luggage case, it will be appreciated that it can be made to accommodate a variety of carrying cases. Also, even though the slide fasteners 39, 70 are shown to be a zipper, other slide fasteners available in the industry can easily be used in both the pocket 64 and the main compartment of case 10. In addition, instead of the panel or trim sections 74, 76, 78 creating a substantially two layer effect with the lining 65, these components 74, 76, 78 can be attached to lining 65 such that there is substantially only a one-layer effect created by the panel sections 76, 78, or the trim sections 74–78 can be arranged such that there is an opening in the middle of cover 14 where the lining material 65 extends slightly beyond the edges of this opening on one side and pocket 64 extends slightly beyond the edges of the trim panels 74–78 on the other side.

I claim:

1. A luggage case having an outer hinged cover with an external pocket, comprising:

a thickness of lining material which is substantially coextensive with said outer cover, a thickness of trim material overlying only a part of the lining material, and having inner and outer peripheral edges, a pocket material overlying at least that portion of the lining material which is not covered by said trim material, said lining material being at least substantially coextensive with said pocket material, said pocket material having outer peripheral edges being substantially in an overlapping relationship with the inner peripheral edges of said trim material, and holding means located along the inner peripheral edges of said trim material and the outer peripheral edges of said pocket material for securing said trim material, said pocket material and said lining material together along a line in order to affix said pocket material and said trim material to said cover.

2. A luggage case according to claim 1, wherein said lining material is relatively lighter and thinner than said trim material and said pocket material, and wherein said trim material and pocket material are of a laminated textured material.

3. A luggage case according to claim 1 wherein said lining material is a backing sheet, and said trim material is an array of individual panel sections arranged around at least three sides of said pocket material.

4. A luggage case according to claim 1, wherein said trim material consists of binding strips wrapped around and along its said inner peripheral edges adjacent to said pocket material, wherein said outer peripheral edges of said pocket material along at least three of its sides are further disposed to peripherally extend beneath said inner pheripheral edges of said trim material and said binding strips, and wherein said securing means consists of stitching along said binding strips of said trim material through said pocket material and said lining material, and welt means which includes one of said outer peripheral edges of a lower poriton of said pocket material and the outer peripheral edges of said trim material.

5. A luggage case according to claim 1, wherein said pocket material comprises:

at least two pieces of flexible material forming an upper portion and a lower portion for said pocket, enclosure means attached to said upper and lower portions for connecting said two pieces of material together and for providing access into said pocket, means at the four corners of said pocket for forming gussets along the longitudinal sides giving depth to said pocket.

6. A luggage case according to claim 5, wherein said enclosure means is slide fastener means and is provided partly on a lower edge of said upper portion of said pocket and partly on an upper edge of said lower portion of said pocket for opening and closing said pocket.

7. A luggage case according to claim 5, wherein said flexible material of said pocket is lightweight and tenuous so as to cause said pocket to collapse upon itself when in a substantially empty condition and to expand to accommodate to the bulkiness of its contents.

8. A luggage case being generally rectangular and having an outer hinged cover generally rectangular in shape, comprising:

a thickness of lining material, a thickness of trim material overlying only a part of said lining material and having inner and outer peripheral edges, an external pocket generally rectangular in shape and overlying at least that portion of the lining material which is not covered by the trim material, said lining material at least substantially coextensive with said pocket and being relatively lighter and thinner than said trim material and said pocket, binding strip means arranged around at least three sides of said pocket in an overlapping relationship with said outer peripheral edges of said pocket and said inner peripheral edges of said trim material, and securing means, including means along said binding strip means for holding said trim material and said pocket to said lining material and for attaching the bottom of said pocket which is the side free from said binding strip means and at least said trim material along its said outer peripheral edges to said cover.

9. A luggage case being generally rectangular and having an outer hinged cover generally retangular in shape, comprising:

a thickness of lining material, a thickness of trim material overlying only a part of said lining material and having inner and outer peripheral edges, an external pocket generally retangular in shape and overlying at least that portion of the lining material which is not covered by the trim material, said lining material at least substantially coextensive with said pocket and being relatively lighter and thinner than said trim material, said pocket having four sides with outer peripheral edges and being of a flexible, tenuous lightweight material similar to that of said trim material, and comprising two parts forming an upper portion and a lower portion between which is located and secured closure means for opening and closing said pocket and dart means forming corners for said upper and lower portions such as to give depth to said pocket in that said pocket extends outwardly in a direction away from the plane of said cover and which combined with said material for said pocket allows said pocket to collapse and to expand according to its contents, binding strip means arranged around at least three sides of said pocket in an overlapping relationship with said outer peripheral edges of said pocket and said inner peripheral edges of said trim material, and securing means, including means along said binding strip means for holding said trim material and said pocket to said lining material and for attaching the bottom of said pocket which is the side free from said binding strip means and at least said trim material along its said outer peripheral edges to said cover.

* * * * *